United States Patent [19]

Stenfors

[11] 4,086,021

[45] Apr. 25, 1978

[54] COOLED GUIDE VANE

[75] Inventor: Svante Bengt Gösta Stenfors, Finspong, Sweden

[73] Assignee: Stal-Laval Turbin AB, Finspong, Sweden

[21] Appl. No.: 760,610

[22] Filed: Jan. 19, 1977

[30] Foreign Application Priority Data

Jan. 19, 1976 Sweden ..... 7600473

[51] Int. Cl.[2] ..... F01D 25/12

[52] U.S. Cl. ..... 415/115; 416/97 A

[58] Field of Search ..... 415/115, 116; 416/96 A, 416/97, 90

[56] References Cited

U.S. PATENT DOCUMENTS

| | | | |
|---|---|---|---|
| 2,920,866 | 1/1960 | Spurrier | 416/96 A |
| 3,540,810 | 11/1970 | Kercher | 415/115 |
| 3,560,107 | 2/1971 | Helms | 416/96 A |
| 3,628,880 | 12/1971 | Smuland | 415/115 |
| 3,698,834 | 10/1972 | Meginnis | 416/96 |
| 3,726,604 | 4/1973 | Helms et al. | 416/96 A |
| 3,806,275 | 4/1974 | Aspinwall | 415/115 |
| 3,806,276 | 4/1974 | Aspinwall | 415/115 |
| 3,809,494 | 5/1974 | Redman | 415/115 |
| 3,963,368 | 6/1976 | Emmerson | 416/97 A |
| 4,021,139 | 5/1977 | Franklin | 415/115 |

FOREIGN PATENT DOCUMENTS

| | | | |
|---|---|---|---|
| 2,555,049 | 6/1976 | Germany | 416/96 A |

*Primary Examiner*—C. J. Husar

*Attorney, Agent, or Firm*—Pollock, Vande Sande & Priddy

[57] ABSTRACT

An improved hollow vane for a gas turbine is cooled by a flow of cooling air through the interior of the vane. Flow guiding plates inserted in the interior of the vane direct coolant flow first to the leading edge of the vane for maximum cooling at that location and then to discharge openings in the trailing edge of the vane.

12 Claims, 9 Drawing Figures

COOLED GUIDE VANE

BACKGROUND OF THE INVENTION

In gas turbines particularly the guide vanes in the first stage or stages are subjected to high temperatures; and therefore, efficient cooling of these members must be provided. A difficult aspect of providing such cooling is proper control of the cooling air as it moves through the narrow space in the guide vane so that an efficient cooling is obtained of the most exposed parts of the turbine vane, which are the leading edge of the blade and the forward positions of its sides.

OBJECTS OF THE INVENTION

An object of the invention is to provide a cooled hollow vane for a gas turbine in which the leading edge and adjacent forward surfaces of the vane are provided with preferential cooling.

Another object of the invention is to provide such a vane which is simple in construction and includes an insert for the interior of the hollow vane which directs cooling air toward the leading edge of the vane.

These objects are given only by way of example. Thus, other desirable objects and advantages inherently achieved by the disclosed invention may be apparent to those skilled in the art. Nonetheless, the scope of the invention is to be limited only by the appended claims.

SUMMARY OF THE INVENTION

The above objects and other advantages are achieved by the hollow vane according to the invention by means of a simple insert for the vane comprised of overlapping flow directing plates. One plate is positioned to block direct flow of cooling air to an exhaust port in the trailing edge of the vane. An overlapping plate is perforated to direct air toward the leading edge. Between the first plate and the vane wall, flow channels are provided to direct flow from the leading edge toward the trailing edge and out of the vane.

BRIEF DESCRIPTION OF THE DRAWINGS

The invention will be described in greater detail with reference to the accompanying drawings showing different views of the various details of the guide vane with its insert. Particularly.

DETAILED DESCRIPTION OF THE PREFERRED EMBODIMENT

Figure 1:
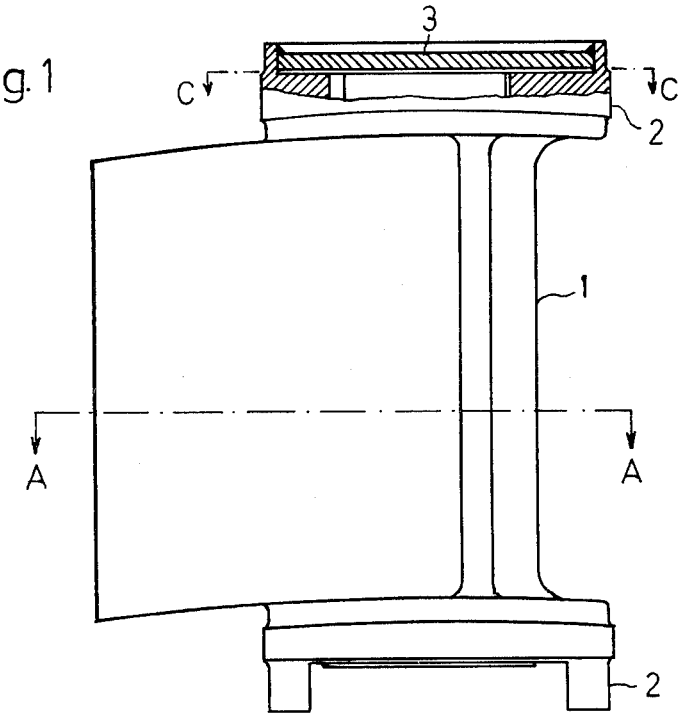
FIG. 1 shows the guide vane seen from the side.
Figure 2:
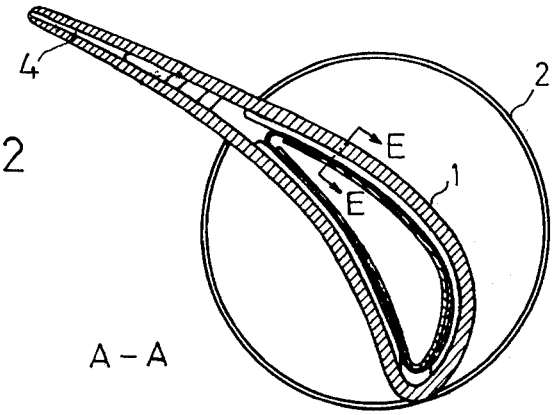
FIG. 2 shows a cross-section taken on line A—A of FIG. 1.

FIGS. 1 and 2 show a blade body 1 which is provided with round flanges 2 at its ends. The guide vane embodying blade body 1 can be arranged for rotation in a blade ring to permit adjusting the inlet angle. Blade body 1 is hollow with its interior opening outwardly through both end flanges 2, one of which, however, for example the upper one, may possibly be closed by a plate 3. Cooling air is blown in through the lower flange 2 of the blade and is blown out through a hole 4 provided at the rear or trailing edge of the blade, as shown in FIG. 2.

Figure 4:
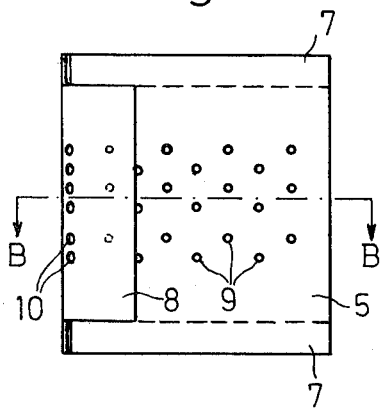
FIG. 4 shows the inner supporting plate for the insert of the turbine vane, seen from the side.
Figure 6:
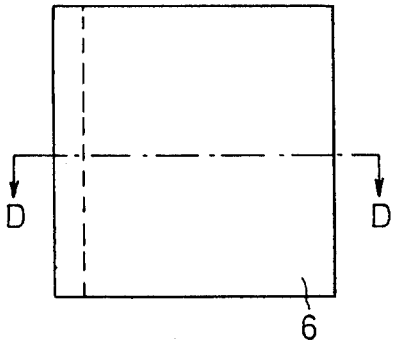
FIG. 6 shows the flexible flow control plate of the insert seen from the side.
Figure 5:
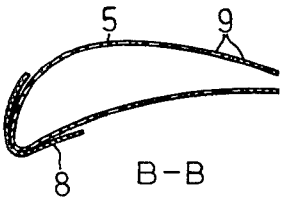
FIG. 5 shows section taken on line B—B of FIG. 4.
Figure 7:
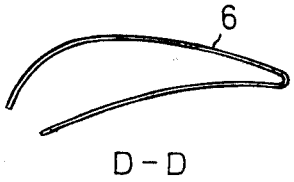
FIG. 7 shows section taken on line D—D of FIG. 6.

To effect a good distribution of the cooling air and thus efficient cooling of the blade portions exposed to the highest temperatures, blade 1 is provided with an insert which comprises an essentially rigid, perforated, inner supporting plate 5, as shown in FIGS. 4 and 5, and a thinner flow control plate 6 outside inner plate 5 as shown in FIGS. 6 and 7. Outer plate 6 preferably is flexible so that it has the characteristics of an elastic diaphragm and preferably is imperforate.

Figure 3:
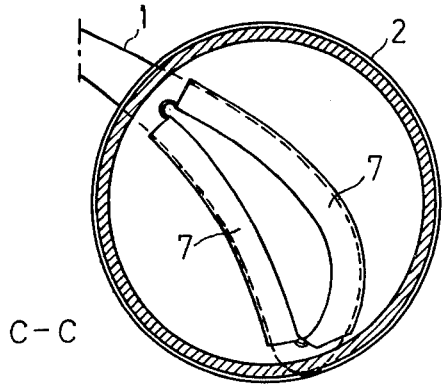
FIG. 3 shows a cross-section taken on line C—C of FIG. 1.

As shown in FIG. 5, supporting plate 5 is bent into substantially the same shape or profile as the inside surface of blade 1 and is open toward the trailing edge of blade 1. The axial height of supporting plate 5 is somewhat greater than the axial height of blade 1 so that a pair of flaps 7 are provided at top and bottom, as indicated in FIG. 4. After plate 5 has been inserted into blade 1, flaps 7 are folded out towards the side as shown in FIG. 3 to form sealing flanges for the space between plate 5 and the inside surface of blade 1.

Outer plate 6 is bent to form a shape or profile similar to that of supporting plate 5, as shown in FIG. 7. Plate 6 has the same axial height as the interior of blade 1 and is open toward the leading edge of blade 1. Because the plates 5 and 6 are open at the back and at the front, respectively, they are able to slide on each other and thus engage themselves tightly against the inside of blade 1 due to the pressure of the cooling air.

To improve the engagement and the tightness between the supporting plate 5 and the front edges of flexible outer plate 6, supporting plate 5 may be provided at its leading edge with a thin attachment plate 8 which preferably is welded to plate 5 in position to cover the front edges of flexible outer plate 6.

Figure 8:
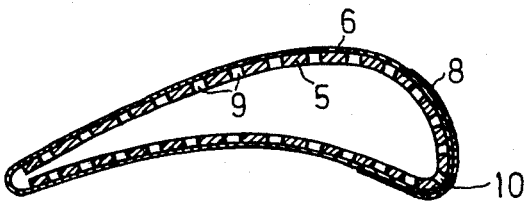
Fig. 8 shows a section through an assembled insert.

A cross-section through an assembled insert is shown in FIG. 8. Supporting plate 5 is provided with perforations 9. Plates 5 and 8 are provided at their front edges with holes 10 for exhausting cooling air toward the leading or front edge of the blade.

Figure 9:
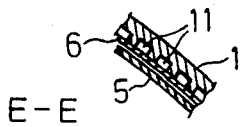
FIG. 9 shows section taken on line E—E of FIG. 2.

The cooling function is best illustrated in FIG. 9 which shows a section E—E through the blade wall and the insert. The blade wall is provided on its inside surface with grooves 11 which are essentially parallel with the direction of flow on the outside of the blade; that is, perpendicular to the longitudinal direction of the blade. The flow channels provided by grooves 11 comprise a means cooperating with the vane wall and flexible plate 6 for permitting flow of cooling air between the wall and the flexible plate toward the trailing edge of the vane.

Cooling air is blown into the blade from its lower end. Because of perforations 9 in supporting plate 5, flexible plate 6 will be pressed out to cover at least a portion of the grooves 11 on the inside surface of blade 1, thereby preventing direct flow of air to the openings in the trailing edge of vane 1. The cooling air is blown out towards the leading edge of blade 1 through holes 10 and then flows at a great speed along the inside of the blade through the grooves 11 between plate 6 and the wall of blade 1. The suction effect caused by this flow strengthens the engagement of flexible plate 6 against the inside of blade 1. Thus, an air flow is obtained which moves closely against the inside of blade 1 and provides an efficient cooling of the blade walls at locations spaced from its leading edge. Finally the cooling air flows out through holes 4 at the trailing edge of the blade, where the air is mixed with the working medium of the turbine. The insert according to the invention will therefore provide an efficient cooling of the most exposed parts of the guide vane, i.e. its leading edge and the forward portions of its sides.

Having described my invention is sufficient detail to enable those skilled in the art to make and use it, I claim:

1. A cooled guide vane for a gas turbine, comprising:
a hollow blade body having a wall, a leading edge and a trailing edge;
means for introducing cooling air flow to the interior of said hollow blade body;
at least one perforation through said wall of said hollow blade body at said trailing edge for exhausting cooling air from the interior of said hollow blade body;
a plurality of grooves on the interior of said wall, said grooves extending essentially parallel with the direction of gas flow over the outside of said hollow blade body;
imperforate plate means, located in the interior of said hollow blade body, and shaped to cover at least a portion of said plurality of grooves, for preventing air flow directly from said means for introducing cooling air to said at least one perforation through said wall, said imperforate plate being open toward said leading edge; and
perforated plate means, located in the interior of said hollow blade body and positioned at least partially within and partially overlapped with said imperforate plate means, said perforated plate means having at least one perforation for passing cooling air to said leading edge of said hollow guide vane,
whereby cooling air from said means for introducing cooling air flows through said at least one perforation in said perforated plate means, through said plurality of grooves and through said at least one perforation through said wall of said hollow blade body.

2. A guide vane according to claim 1, wherein said perforated plate means is spaced from the interior of said wall and comprises a pair of edges, one folded over each end of said hollow blade body for sealing the space between said perforated plate means and the interior of said wall.

3. A guide vane according to claim 1, wherein said imperforate plate means is flexible whereby it may be displaced to cover said grooves in response to cooling air flowing through the guide vane, and said perforated plate means is essentially rigid whereby it supports said imperforate plate means.

4. A guide vane according to claim 1, wherein said perforated plate means is open towards said trailing edge of said hollow blade body.

5. A guide vane according to claim 3, further comprising attachment plate means for covering said perforated plate at said leading edge and overlapping said imperforate plate at the location where said imperforate plate opens toward said leading edge; said attachment plate means having at least one perforation corresponding in location to said at least one perforation in said perforated plate means.

6. A guide vane according to claim 3, wherein said perforated plate means is open towards said trailing edge of said hollow blade body.

7. A cooled gas vane for a gas turbine, comprising:
a hollow blade body having a wall, a leading edge and a trailing edge;
means for introducing cooling air flow to the interior of said hollow blade body;
at least one perforation through said wall of said hollow blade body at said trailing edge for a exhausting cooling air from the interior of said hollow blade body;
flow control plate means, located in the interior of said hollow blade body and shaped to conform to the shape of at least a portion of the interior of said wall, for preventing air flow directly from said means for introducing cooling air to said at least one perforation through said wall, said flow control plate being open toward said leading edge;
flow channel means cooperating with said wall and said flow control plate means for permitting flow of cooling air between said wall and said flow control plate means;
perforated plate means, located in the interior of said hollow blade body and positioned at least partially within and partially overlapped with said flow control plate means, said perforated plate means having at least one perforation for passing cooling air toward said leading edge of said hollow guide valve,
whereby cooling air from said means for introducing cooling air flows through said at least one perforation in said perforated plate means, between said wall and said flow control plate means and through said at least one perforation through said wall of said hollow blade body.

8. A guide vane according to claim 7, wherein said perforated plate means is spaced from the interior of said wall and comprises a pair of edges, one folded over each end of said hollow blade body for sealing the space between said perforated plate means and the interior of said wall.

9. A guide vane according to claim 7, wherein said flow control plate means is flexible whereby it may be displaced in response to cooling air flowing through said guide vane; said perforated plate means is essentially rigid whereby it supports said flow control plate means; and said flow channel means comprises a plurality of grooves on the interior of said wall, said grooves extending essentially parallel with the direction of gas flow over the outside of said hollow blade body.

10. A guide vane according to claim 7, wherein said perforated plate means is open towards said trailing edge of said hollow blade body.

11. A guide vane according to claim 9, further comprising attachment plate means for covering said perforated plate at said leading edge and overlapping said flow control plate at the location where said flow control plate opens toward said leading edge; said attachment plate means having at least one perforation corresponding in location to said at least one perforation in said perforated plate means.

12. A guide vane according to claim 9, wherein said perforated plate means is open towards said trailing edge of said hollow blade body.

* * * * *